US007784356B2

(12) United States Patent
Spiers et al.

(10) Patent No.: US 7,784,356 B2
(45) Date of Patent: Aug. 31, 2010

(54) INSPECTION SYSTEMS AND METHODS FOR MULTI-SEGMENT PRODUCTS

(75) Inventors: Steven F. Spiers, Richmond, VA (US); Jeremy J. Straight, Midlothian, VA (US); Travis M. Garthaffner, Midlothian, VA (US); Janet L. Thompson, Chesterfield, VA (US); Yeu-Hwa Shyy, Midlothian, VA (US)

(73) Assignee: Philip Morris USA Inc., Richmond, VA (US)

( * ) Notice: Subject to any disclaimer, the term of this patent is extended or adjusted under 35 U.S.C. 154(b) by 367 days.

(21) Appl. No.: 12/019,217

(22) Filed: Jan. 24, 2008

(65) Prior Publication Data

US 2009/0005989 A1 Jan. 1, 2009

Related U.S. Application Data

(60) Provisional application No. 60/941,017, filed on May 31, 2007.

(51) Int. Cl.
*G01N 3/02* (2006.01)
*G01N 19/08* (2006.01)

(52) U.S. Cl. ..... 73/856; 73/865.8; 73/866

(58) Field of Classification Search ..... 73/856–858, 73/865.8, 866; 131/906
See application file for complete search history.

(56) References Cited

U.S. PATENT DOCUMENTS 3,138,951 A * 6/1964 Scott ..... 73/81
3,633,590 A * 1/1972 Pocock et al. ..... 131/65
3,738,376 A * 6/1973 Labbe et al. ..... 131/84.4
4,116,602 A 9/1978 Hall
4,157,370 A 6/1979 Van Hall
4,274,317 A * 6/1981 Vulliens ..... 83/74
4,403,619 A * 9/1983 Dahlgrun ..... 131/280
4,413,637 A * 11/1983 Irving ..... 131/84.1
4,472,960 A * 9/1984 Motoyama et al. ..... 73/7
4,685,475 A * 8/1987 Ridler et al. ..... 131/84.1
4,907,607 A * 3/1990 Focke et al. ..... 131/280
4,986,285 A * 1/1991 Radzio et al. ..... 131/280
5,002,072 A * 3/1991 Dawson ..... 131/109.1
5,311,291 A * 5/1994 Cholet ..... 356/640
5,347,853 A * 9/1994 Hoppe et al. ..... 73/82
5,583,633 A * 12/1996 Matsumura et al. ..... 356/237.2
6,075,882 A * 6/2000 Mullins et al. ..... 382/141
6,264,591 B1 7/2001 Keen et al.
6,385,333 B1 5/2002 Puckett et al.

(Continued)

*Primary Examiner*—David A. Rogers
(74) *Attorney, Agent, or Firm*—Connolly Bove Lodge & Hutz LLP

(57) ABSTRACT

Inspection systems and methods for their use comprise: a movable carrier with spaced receptacles, each sized to accept a sample; a first pin positioned proximate to the movable carrier and connected to a first movable member capable of reciprocally moving the first pin alternately into and out of contact with a first end of a sample disposed in one of the spaced receptacles; a second pin positioned proximate to the movable carrier and connected to a second movable member capable of reciprocally moving the second pin alternately into and out of contact with a second end of the sample disposed in the one of the spaced receptacles; a measurement sensor capable of determining a value associated with the sample disposed in the one of the spaced receptacles; and an evaluation device in communication with the measurement sensor for receiving the value, the evaluation device providing a comparison between the value and a predetermined value.

25 Claims, 2 Drawing Sheets

U.S. PATENT DOCUMENTS 6,394,097 B1 5/2002 Okumoto et al.
6,578,583 B2 6/2003 Smith et al.
6,763,838 B2 7/2004 Suzuki et al.
7,079,912 B2 7/2006 Stack et al.
2006/0098214 A1* 5/2006 Wilson et al. ..... 356/634
2006/0112963 A1 6/2006 Scott et al.

* cited by examiner

INSPECTION SYSTEMS AND METHODS FOR MULTI-SEGMENT PRODUCTS

CROSS REFERENCE RELATED TO APPLICATION

The present application claims the benefit of provisional application Ser. No. 60/941,017, filed May 31, 2007, for all useful purposes, and the specification and drawings thereof are included herein by reference.

BACKGROUND OF THE INVENTION

The present invention relates, in general, to quality control inspection of, preferably cylindrical, multi-component articles, and more particularly to systems and methods for the inspection of cigarette filter assemblies which systems and methods can be operated and carried out in a high speed manner.

Quality control is important in all phases of manufacturing for many reasons, including product quality, customer satisfaction, production cost management, and speed of manufacture. While the following background description and subsequent description of the invention focus on preferred applications directed to cigarette filter assembly inspection, the present invention is applicable to various processing and production environments in which multi-segment products are produced and unwanted voids or improper segment dimensions can occur within an outer enclosure of the product which prevents ordinary visual inspection without destruction of the product, and where high speed operation is important.

Cigarette manufacturing is generally a high speed process where thousands of individual cigarettes can be made from shredded tobacco, rolls of cigarette paper, and, optionally, filters, in a given minute of operation. In many standard production processes, tobacco enters a machine and is wrapped with cigarette paper to form a continuous rod, and the rod is then cut into single or double-length cigarettes, appended with filters, and ultimately output for packaging. Such processes provide various opportunities for defect formation. For example, the density of the tobacco rod forming a particular cigarette can be an issue. If the rod is determined to be too heavy, for example, then too much tobacco is being used, which can be wasteful. Similarly, for example, a misplaced splice in the cigarette wrapping paper, loose tobacco at an end of a cigarette rod, and improperly attached or missing filters can result.

Another significant problem in high speed production processes relates to the manufacture of multi-segment assemblies, such as, for example, some cigarette filters. For example, some filter assemblies are manufactured to include two or more filter materials such as cellulose acetate separated by another granular material such as activated charcoal. The several segments are provided within a paper wrapping resulting in a multi-segment filter tip which can be attached to a tobacco rod to produce a cigarette. Often, such filters are prepared as extended rod assemblies with several multi-segment groups joined together in one continuous paper rod which is ultimately cut at predetermined positions to provide two or more individual filter tips.

During the high speed production of such rod-shaped products, filling of materials can be less than ideal and unwanted voids or imperfect filling (low density) in a given segment can occur resulting in filters that bend, twist or compact during subsequent processing and produce cigarettes that must be discarded. Additionally, over filling or misalignment of an end-segment can occur resulting in a filter segment material protruding from the wrapping paper.

Thus, during high speed manufacture of cigarettes and like products, quality control parameters are often monitored and reactive measures can be taken to modify the production process or reject the out-of-specification products. Final products can be given an exterior optical inspection, for example using a video camera. The image can be analyzed for the presence of defects. Density inspections have also been suggested in which a cigarette or rod is exposed to some form of electromagnetic radiation to determine density via transmittance of the radiation. Such known inspection systems are not typically concerned with relative placement of internal components of the cigarette, because a tobacco rod and filter typically abut. Moreover, such inspection systems generally evaluate a finished product and do not reject a filter assembly prior to its attachment to a tobacco rod. Accordingly, while an adjustment can later be made to a production line, the tobacco has already been wasted.

Multi-segment cigarette filters can require additional inspections The relative positioning of the interior components of such filter assemblies can be crucial to their proper operation and should be carefully monitored. Visual inspection of a final product to determine the relative placement of components is generally not possible without disassembling the finished cigarette due to the various layers paper or other material surrounding the components. Such disassembly would likely disturb the interior spacing and would, in any event, occur too late in the manufacturing process to provide useful feedback for correcting machine settings in a timely manner. Moreover, known inspection systems which optically measure one or more dimensions of a finished product, do not inform the manufacturer of the presence of voids or loose packing. Visual evaluation of dimensions is limited to exterior wrapping paper and does not provide reliable product quality information.

Accordingly, there is a need in the art for inspection systems and methods that provide reliable quality information for multi-segment products which can contain unwanted voids, loose packings or misaligned segment, and which can provide the information in high speed operations.

BRIEF SUMMARY OF THE INVENTION

The present inventors have developed inspection systems and methods of inspecting multi-segment products that provide reliable and effective evaluation of quality addressing both dimensional analysis and structural integrity (i.e., detection of unwanted voids and loose fillings). The inventive systems and methods can also advantageously provide evaluation in high speed operations. The inspection systems and methods in accordance with the various embodiments of the invention can provide for the inspection and evaluation of one or more parameters associated with a multi-segment assembly including, for example, overall length, identification of unwanted protrusions or recesses, detection of unwanted voids or loose fillings, and can accomplish the evaluation at high speeds. Furthermore, the inspection systems and methods of the present invention allow inspection of multi-segment filter assemblies during production prior to tipping of a tobacco rod, as opposed to a final inspection after completion of an entire filter-tipped cigarette. Moreover, the inspection systems and methods in accordance with the various embodiments of the invention can further provide for the rejection of multi-segment assemblies which are determined to be unacceptable. Because the inspection systems and methods in accordance with the various embodiments of the invention can operate at high speeds, the systems and methods can be integrated into existing production lines.

One embodiment of the present invention includes an inspection system comprising, a movable carrier having a plurality of spaced receptacles, each spaced receptacle sized to accept a filter assembly; a first pin positioned proximate to the movable carrier and connected to a first movable member capable of reciprocally moving the first pin alternately into and out of contact with a first end of a filter assembly disposed in one of the spaced receptacles; a second pin positioned proximate to the movable carrier and connected to a second movable member capable of reciprocally moving the second pin alternately into and out of contact with a second end of the filter assembly disposed in the one of the spaced receptacles; a measurement sensor capable of determining a value associated with the filter assembly disposed in the one of the spaced receptacles; and an evaluation device in communication with the measurement sensor for receiving the value, the evaluation device providing a comparison between the value and a predetermined value.

Another embodiment of the present invention includes a method comprising: (a) providing a filter assembly in a receptacle disposed on a movable carrier; (b) contacting a first end of the filter assembly with a first pin, the first pin having a contact end and a non-contact end; (c) contacting a second end of the filter assembly with a second pin, the second pin having a contact end and a non-contact end; (d) measuring a value associated with the filter assembly while the first pin contact end and the second pin contact end are in contact with the filter assembly; and (e) comparing the value to a predetermined value.

In various preferred embodiments of the invention, an inspection system can be integrated into the production of multi-segment cigarette filter assemblies produced using a vertical filling apparatus, for example, as disclosed in U.S. Patent Application Publication No. 2006/0112963, published on Jun. 1, 2006, the entire contents of which are hereby incorporated herein by reference. Thus, for example, in such embodiments, an inspection system of the present invention can be incorporated into the production after production of a multi-segment filter rod, and preferably, prior to cutting of the rod into individual filter tips.

BRIEF DESCRIPTION OF THE SEVERAL VIEWS OF THE DRAWING

The foregoing summary, as well as the following detailed description of the invention, will be better understood when read in conjunction with the appended drawings. For the purpose of illustrating the invention, there are shown in the drawings embodiments which is presently preferred. It should be understood, however, that the invention is not limited to the precise arrangements and instrumentalities shown.

In the Figs..

DETAILED DESCRIPTION OF THE INVENTION

Figure 1:
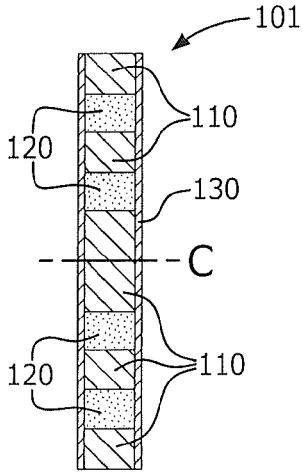
FIG. 1 ( Prior Art )
FIG. 1 is a cross-sectional view of a rod-shaped, multi-segment cigarette filter assembly which can be inspected in accordance with an embodiment of the invention.

As used herein, the singular terms "a" and "the" are synonymous and used interchangeably with "one or more" or "at least one" unless the context clearly indicates a contrary meaning. Accordingly, for example, reference to "a sensor" herein or in the appended claims can refer to a single sensor or more than one sensor. Additionally, all numerical values, unless otherwise specifically noted, are understood to be modified by the word "about." Also, reference is made herein to preferred embodiments for inspecting and evaluating rod-shaped cigarette filter assemblies. While reference may be made generically to "a sample", or more particularly to "a filter assembly," unless the context clearly indicates otherwise, both references (sample and filter assembly) are used interchangeably to describe the systems and methods of the invention broadly, and no limitation to use with only rod-shaped cigarette filter assemblies in any particular embodiment is to be implied.

An inspection system in accordance with the various embodiments of the present invention refers, in general, to a movable carrier, along with a first and a second pin working in conjunction with a measurement sensor and an evaluation device to compare a measured value to a predetermined value. Thus, in general, an inspection system refers to such a group of elements which provides a measurement associated with a sample, preferably a rod-shaped filter assembly, and evaluates that measurement against a predetermined value. Preferably, an inspection system according to the various embodiments of the invention further includes an ejector or release for disposing or removing unacceptable samples from the production cue.

Inspection systems in accordance with various embodiments of the present invention include a movable carrier. A movable carrier in accordance with the various embodiments of the invention comprises a support surface or structure capable of moving relative to a fixed point. A movable carrier suitable for use in accordance with the various embodiments of the invention has a plurality of spaced receptacles disposed on, or integrally formed in, or otherwise associated with, the movable support surface or structure, wherein each of the spaced receptacles is sized to accept a sample to be inspected. In accordance with preferred embodiments of the present invention, samples to be inspected include filter assemblies, and in particular rod-shaped cigarette filter assemblies. Accordingly, preferred embodiments of the inspection systems according to the invention include a plurality of spaced receptacles sized to accept such a filter assembly.

In general, the movable carrier is capable of moving relative to a fixed point. The fixed point is generally the position of a measurement sensor, thus providing for successive positioning of multiple samples in line with the measurement sensor for appropriate measurement. Thus, while a movable carrier must provide for transport of samples to be evaluated during the inspection, the measurement sensor is not required to be fixed relative to the movable carrier. It is however preferable to fix the measurement sensor relative to the movable carrier to minimize the need for additional calibrations and reduce sources of measurement error associated with movement of the sensor.

Suitable movable carriers in accordance with the invention include any movable surface having recesses, protrusions, extended members, or other structures of corresponding shape and size suitable for accepting a filter assembly. Examples of suitable movable carriers which can be used in inspection systems according to the present invention include belts and other conveyor-like devices having an outer surface which can be configured with a plurality of spaced receptacles, drums having an outer surface which can be configured with a plurality of spaced receptacles, discs, wheels and the like which can provide a surface that can be moved relative to a fixed point, preferably at high speed. As used herein, "high speed" refers in general to filter rod assembly mass production rates known in the art of multi-component cigarette filter manufacturing.

In various preferred embodiments of inspection systems according to the present invention, a movable carrier comprises a rotatable drum. Generally, a rotatable drum suitable for use in accordance with the invention can have any size or shape so long as it has a surface which can accommodate a plurality of spaced receptacles sized to accept a filter assembly. Rotatable drums suitable for use in inspection systems of the present invention can be comprised of materials, such as, for example, metals, plastics, and composites. Any material capable of being molded or machined into a drum shape and which can also have receptacle disposed on or formed on a surface thereof surface can be used. Rotatable drums suitable for use in accordance with the invention have an axis of rotation and an outer circumferential surface, preferably parallel to the axis of rotation of the rotatable drum.

Preferably, the plurality of spaced receptacles are disposed along the circumferential surface of the rotatable drum, or surface of the movable carrier, and more preferably comprise a series of equally spaced parallel grooves disposed along the surface. As used herein "parallel" implies a generally parallel relationship such that any two neighboring grooves do not intersect on the surface of the movable carrier, or rotatable drum in such preferred embodiments, but does not imply a perfectly parallel geometric relationship among any two or more of the grooves. For example, in various embodiments wherein the movable carrier can include a disc, the plurality of spaced receptacles are also preferably equally spaced parallel grooves wherein parallel implies that the grooves are disposed such that they do not intersect on the surface of the disc and rod-shaped assemblies positioned in the grooves do not interfere with one another to the extent that any one assembly is displaced from its groove.

A plurality of spaced receptacles in accordance with the present invention preferably comprises a series of equally spaced apart sample receptacles. As used herein, equally spaced apart refers to the regularity of the spacing. Thus, preferably, the receptacles are regularly spaced such that each receptacle is spaced similarly apart from the preceding and succeeding receptacles on the surface of the movable carrier. Regular spacing can provide for more accurate measurement and more reliable operation at high speeds. "Equally spaced apart" does not necessitate a constant, invariable distance between each receptacle, but rather a regular spacing commensurate with a tolerance determined by the iterative nature of the measurement sensor. For example, where a measurement sensor, such as a camera, is configured to take a measurement at 0.1 second intervals, the plurality of spaced receptacles are preferably equally spaced such that one of the plurality passes within the operable view of the camera every 0.1 seconds. Such a plurality is deemed "equally spaced" if a receptacle passes within the view of the sensor at each iteration, even if the distance between each receptacle varies to some degree.

Preferred embodiments of inspection systems according to the present invention including a rotatable drum having a plurality of equally spaced apart parallel grooves. Each of the equally spaced apart parallel grooves, can be sized such that the radius of each groove corresponds to the radius of a cylindrical filter assembly.

Inspection systems in accordance with the present invention can be used to compare a measured value against a predetermined value for evaluating quality compliance for various samples, and preferably filter assemblies. Preferably, filter assemblies evaluated in accordance with inspection systems of the present invention comprise cigarette filter assemblies having a rod-like structure. In particular, the inspection systems according to the various embodiments of the invention can be used to evaluate measurements associated with multi-segment filters for cigarettes. Such measurements associated with generally cylindrical multi-segment samples are described in more detail below. Various types of multi-segment filters for cigarettes are known and generally comprise two or more spaced apart sections of an entrainment-type filter material such as cellulose acetate with intermediate sections which can be filled with granular absorption-type material or other particulate material. Such filters can be manufactured in a variety of known ways. Such multi-segment rod-shaped filters can comprise two or more cellulose acetate plugs separated by a granular or other particulate absorption-type material, such as activated charcoal, wrapped in a strip of wrapper paper to form a continuous rod of repeating sections of filter material. Accordingly, rod-like filter assemblies have a generally cylindrical shape and thus an overall length and a diameter or radius associated with the generally cylindrical shape.

For example, referring to FIG. 1, a schematic representation of a multi-segment cigarette filter assembly is shown in a cross-sectional view. The multi-segment cigarette filter assembly 101 comprises several segments of an entrainment-type material 110, such as cellulose acetate, separated by several segments of an absorption-type particulate material 120, such as activated charcoal. The series of entrainment-type material segments 110 and absorption-type particulate material segments 120 are wrapped with a piece of cigarette wrapping paper 130 to form a generally cylindrical rod-shaped filter assembly. Such assemblies can be prepared as continuous, multiple filter segments to be cut into individual filter tips at a later stage of production. For example, in FIG. 1, the filter assembly shown can be split at cut line C-C to form two individual filter tips. Cutting can be accomplished in any suitable manner with any applicable cutting device known in the art or to be developed.

In general, a receptacle in accordance with the invention is sized to accept a sample to be evaluated. As used herein, a receptacle "sized to accept" a sample comprises a recess, protrusion or other construct on the surface of the movable carrier which can accommodate the sample. Accordingly, the receptacle is large enough to accommodate the sample, and generally sized and/or shaped to hold the sample during evaluation. A receptacle can be large enough to accommodate the sample without encompassing the entire sample. For example, in the case of rod-shaped filter assemblies, a receptacle sized to accept the assembly can be shorter than the overall length of the assembly, and/or can comprise a groove or fluted recess in a surface of the movable carrier such that a portion of the longitudinal cross-section of a rod-shaped assembly, but not all of it, fits within the receptacle. As mentioned above, in various preferred embodiments, a receptacle comprises a groove or fluted channel that has a size and shape corresponding to the size and shape of rod-shaped filter assemblies to be evaluated. Additionally, a receptacle sized to accept a filter assembly can accordingly be larger than the filter assembly so long as the receptacle is capable of holding the filter assembly during movement of the movable carrier.

While preferred embodiments of the present invention include inspection systems wherein the plurality of spaced receptacles comprise recesses (i.e., grooves or fluted channels) in a surface of the movable carrier, other suitable receptacles can include, for example, protrusions from the surface of the movable carrier forming opposing restraints for holding a sample, or a movable restraint such as a clasp which may be biased.

In particularly preferred embodiments of the present invention, the movable carrier comprises a rotatable drum having a series of equally spaced apart, parallel grooves on the circumferential surface of the rotatable drum, the surface and the grooves disposed thereon extend in a direction parallel to the axis of rotation of the rotatable drum, and each of the grooves has a fluted shape with a radius generally corresponding to the dimensions of the cylindrical filter assemblies to be evaluated. More preferably, the axis of rotation of the rotatable drum is generally vertical (i.e., normal to the production floor).

Inspection systems in accordance with the various embodiments of the invention further include a first pin and a second pin. Each of the first pin and second pin are positioned proximate to the movable carrier. As used herein, "proximate" refers only to positioning of the pins at such a distance and position that each of the first pin and the second pin is capable of being moved into and out of contact with a first end and a second end, respectively, of a particular sample disposed in one of the receptacles. Proximate positioning as used herein does not imply any maximum distance or particular position at which pins must be disposed so long as they can be moved into and out of contact with the sample. Each pin is generally cylindrical, like samples in preferred embodiments, but can be an object of any shape. Each pin has a surface or portion which can be brought into contact with an end of the sample to be evaluated. Accordingly, pins may be hollow or solid so long as at least one surface is disposed to contact an end of the sample. A pin surface for contact with a sample can be shaped, for example as a dome, or can be flat. Pins suitable for use in the present invention can be made of any suitable material similar to drum materials, including, for example, metals, plastics and composites. In various preferred embodiment, a first pin and/or a second pin can have a contact end which is dimensioned smaller than normally sized sample ends. For example, where samples comprise rod-shaped cigarette filter assemblies, the contact end of a pin can be dimensioned such that its diameter is smaller than the diameter of the filter assemblies being measured such that contact between the pin and the filter assembly is limited to pin-to-internal segment contact. In other words, the dimensionally smaller pin can fit inside the outer circumference of the filter assembly formed by the wrapping paper.

Generally, a first pin is connected to a first movable member and a second pin connected to a second movable member. Each movable member can comprise an arm or bar, one end of which can move up and down relative to a pivot point away from the vertical axis of a filter assembly to bring the first pin and/or second pin into and out of contact with an end of the filter assembly. Alternatively, a movable member can include a reciprocating arm or bar in line with the vertical axis of a filter assembly, where the movable member and connected pin are positioned above and/or below the assembly such that the reciprocating motion of the arm or bar brings the pin into and out of contact with the assembly. Combinations of such movable members can be used as well. Accordingly, an arm or bar movably mounted to a pivot point can be positioned to move a first pin into and out of contact with a first end of an assembly, while a reciprocating bar connected to a second pin can be positioned in line with the other end of an assembly. Any member which is capable of moving to bring the pin to which it is connected reciprocally into and out of contact with an end of a filter assembly can be used in conjunction with the inspection systems of the present invention. As used herein, a first end of the filter assembly and a second end of the filter assembly refer to opposite ends thereof.

In various particularly preferred embodiments of the present invention, an inspection system can include a first rotating ring and/or a second rotating ring, more preferably both, disposed proximate to the alternate (non-circumferential) sides of a rotatable drum wherein each of the first rotating ring and second rotating ring comprises a plurality of segments, each segment comprising an arm or bar connected to a pin. Thus, each rotating ring comprises a series of pins connected to radially-extending members forming a pinwheel-like arrangement of pins connected to arms. Thus, the radially-extending members do not move relative to one another, but can move the pins connected to each member relative to a plane of rotation. Accordingly, the first rotating ring and the second rotating ring can be centered on the axis of rotation of the rotatable drum and positioned at a non-right angle to the axis of rotation. In other words, the first rotating ring and the second rotating ring are positioned to rotate on a plane which is not parallel to the plane of rotation of the rotating drum (i.e., the plane which is perpendicular to the axis of rotation). In accordance with such preferred embodiments of the inspection systems according to the present invention, the first rotating ring and second rotating ring are disposed such that the pins connected to the plurality of radially-extending members are brought to and back away from a point closest to the rotatable drum by virtue of their disposition at a non-right angle to the axis of rotation of the rotatable drum.

Most preferably, both a first rotating ring and a second rotating ring are used together and they are positioned such that the pins of the first ring and the pins of the second ring are superimposed if viewed from above, and such that the pins of each ring approach the point closest to the rotatable drum at the same time such that the pins of each ring are brought into, and back out of contact with a sample at the same time. However, it is to be understood that a single rotating ring can be used in conjunction with a movable member connected to a second pin positioned proximate to the opposite end of a sample.

In order to bring the pins of a rotating ring into and out of contact with a sample, the rotating ring is positioned at a non-right angle to the axis of rotation of the rotatable drum. The non-right angle at which a rotating ring is disposed relative to the axis of rotation of the rotatable drum can depend on a number of factors. Factors which influence the selection of a non-right angle include the degrees of rotation of the drum where the sample is disposed (i.e., the angular distance from the point at which the sample is transferred onto and off of the drum), the desired time of contact between pin and end of sample, and the diameter of the drum. In various preferred embodiments according to the present invention, a rotating ring is disposed at an angle +/−3° of perpendicular to the axis of rotation.

Inspection systems in accordance with the present invention further include a measurement sensor. Measurement sensors suitable for use in accordance with the present invention include any sensing device capable of determining a value associated with the filter assembly and can include, but are not limited to, various cameras. In preferred embodiments of inspection systems according to the invention, the measurement sensor comprises a line scan camera, or other device capable of optical evaluation of a filter assembly. Measurement sensors, and in particular cameras in accordance with such preferred embodiments of the present invention, are capable of determining a value associated with the filter assembly by visual measurement of a dimension associated with the filter assembly. Additionally, cameras can be used in accordance with inspection systems of the present invention to determine percentage fill of granular cavaties, or more particularly, light transmittance through a filter assembly (i.e., brightness).

Inspection systems according to the various embodiments of the present invention can further include a high intensity light source. Suitable high intensity light sources include lamps and other filament-based projection devices, as well as light-emitting diodes. A high intensity light source is preferably positioned in conjunction with an inspection system of the present invention such that a filter assembly disposed in a spaced receptacle can pass between the high intensity light source and the measurement sensor of the inspection system. As used herein high intensity refers to a light source capable of projecting light that will transmit through a filter assembly which is not completely filled. Accordingly, the high intensity light source must be able to transmit light through cigarette filter wrapper paper at a minimum.

In general, a measurement sensor suitable for use in the inspection systems and methods of the present invention is capable of determining a value associated with the sample, e.g., a filter assembly. Values associated with a generally cylindrical sample can include dimensions, such as overall length and diameter, density (i.e, the degree of compaction of a material in a sample), an off-set of interior materials in relation to an outer casing of the sample, for example, a protrusion or recess of a segment material in relation to an end of the outer wrapping paper in the case of a filter assembly. Additional values associated with samples can include the location and/or size of a registration mark on a sample.

Inspection systems according to the various embodiments of the present invention further include an evaluation device. Evaluation devices suitable for use in accordance with the present invention are capable of receiving communicated information from the measurement sensor. Accordingly, evaluation devices which can be used in inspection systems of the present invention can receive the value determined by the measurement sensor. An evaluation device can receive the data in whatever form transmitted by the measurement sensor and transform or interpret the data received to provide a comparison of the measured value against a predetermined value. For example, the evaluation device can receive data as a photograph and convert the photograph to numerical information using applicable software, or the evaluation device can receive data directly in numerical form.

In preferred embodiments of the present invention the evaluation device can comprise a processor. Suitable processors can be programmed with predetermined values and compare the measured value received from the measurement sensor against the predetermined value to determine whether the measured value varies from the predetermined value by an acceptable or unacceptable amount. Thus, an evaluation device can be provided with: a threshold value, that is a minimum or a maximum; or a tolerance, that is a range of acceptable values with a minimum and a maximum. Additionally, an evaluation device can be provided with an adjustable predetermined value that can change as further comparisons are made. For example, where consistency is given weighted importance, an evaluation device can adjust a programmed tolerance to narrow the previously programmed predetermined value to fit an empirically measured narrower range of values. The evaluation device in accordance with inspection systems of the present invention can be placed in communication with the measurement sensor, and other devices if desired, by any suitable form of communication including wiring and radio communication.

Inspection systems in accordance with the present invention can further include an ejector associated with the movable carrier. Ejectors in accordance with the present invention can be in communication with the evaluation device to receive a rejection signal when a measured value does not compare favorably with a predetermined value. The ejector can be signaled by the evaluation device to provide for removal of a non-compliant sample from the receptacle. A non-compliant sample being one for which a measured value compares unfavorably to the predetermined value.

A suitable ejector which can be used in conjunction with the inspection systems of the present invention can include a variable vacuum source provided in conjunction with a receptacle and in communication with the evaluation device. Thus, in various embodiments, when the evaluation device determines that the measured value is not compliant with a predetermined value, a rejection signal can be sent to the variable vacuum source, and the variable vacuum can be temporarily reduced or removed to eject the sample from a receptacle. In embodiments in which an ejector comprises a variable vacuum, it is not absolutely necessary to completely remove the vacuum in order to eject a sample from a receptacle. For example, in the case of a movable carrier comprising a rotating drum having a plurality of recessed grooves as receptacles, a vacuum can serve to hold the samples in place while the drum rotates, and only a reduction of the vacuum may be needed to release or eject a non-compliant sample from its receptacle as the centrifugal force from the rotation can exceed the opposing force of the reduced vacuum, depending upon factors such as, for example, diameter of the drum, rotational speed, and sample weight.

In other various embodiments of inspection systems according to the present invention, an ejector can comprise an extendable, flexible, pivotable or enlargeable member positioned within or proximate to a receptacle such that when a rejection signal is received the member extends, flexes, pivots or enlarges from its original state in or near the receptacle to eject the sample from the receptacle. In still other embodiments of inspection systems according to the present invention, wherein a receptacle comprises an external construct disposed on a surface of a movable carrier, the ejector can include a releasable hinge such that when a rejection signal is received, the external construct is released at the hinge allowing the sample to be released from the receptacle.

Figure 2:
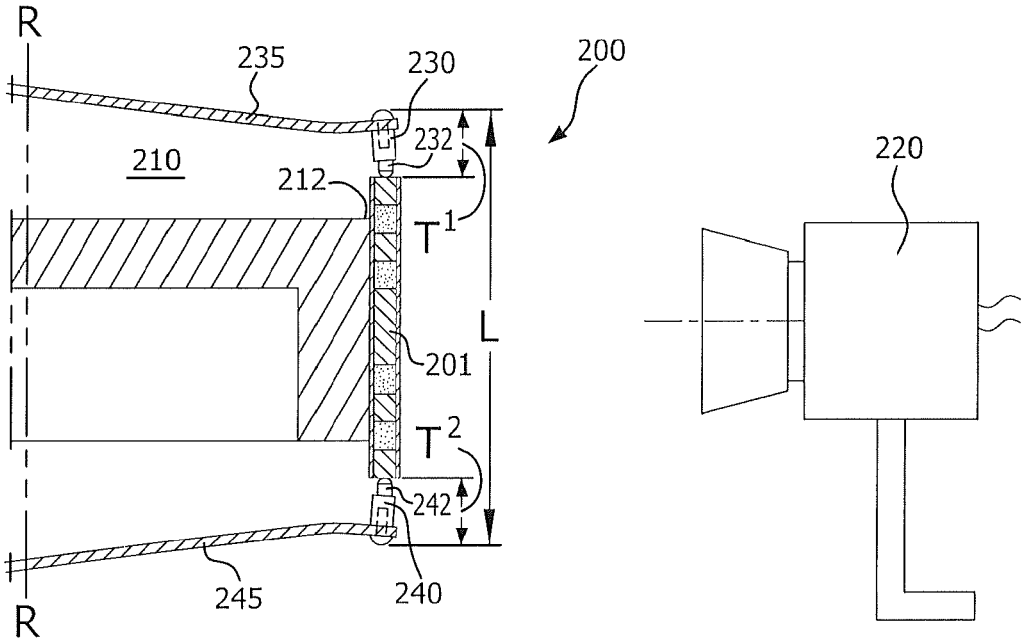
FIG. 2 is a cross-sectional view of an inspection system in accordance with an embodiment of the invention.
Figure 3:
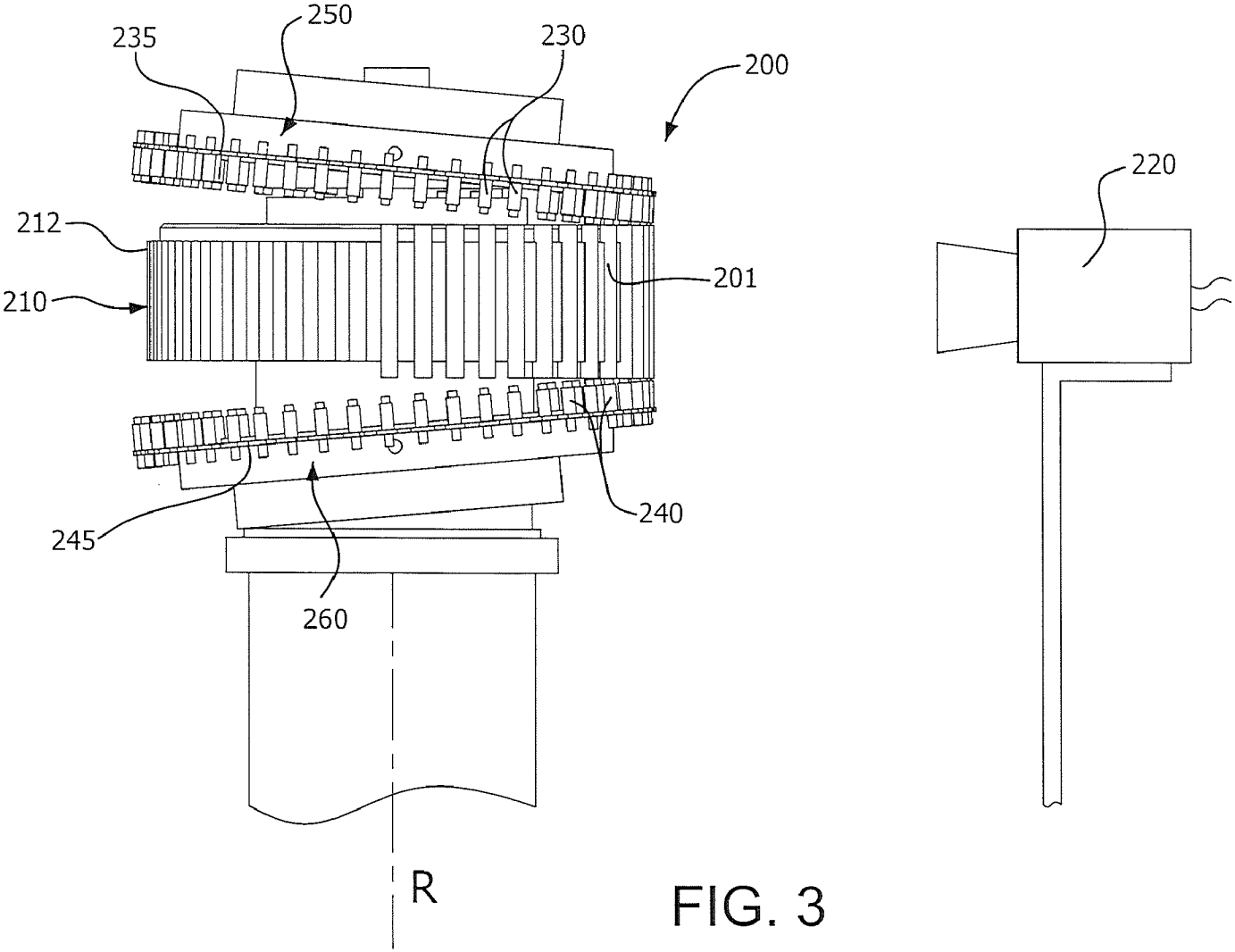
FIG. 3 is a side elevational view of the inspection system as shown in FIG. 2.

Referring to FIGS. 2 and 3, one embodiment of an inspection system according to the invention is schematically depicted in cross-sectional view. The inspection system 200 includes a rotatable drum 210 having an axis of rotation represented by line R-R, a camera 220, a first pin 230 connected to a movable member 235, a second pin 240 connected to a movable member 245, and an evaluation device (not shown) which is in communication with the camera 220. In the embodiment shown in FIGS. 2 and 3, a rod-shaped, multi-segment cigarette filter assembly 201 is disposed in a groove 211 disposed on the circumferential surface 212 of the drum 210.

First pin 230 and second pin 240 are shown in contact with the ends of the filter assembly 201. Contact end 232 of the first pin 230 and contact end 242 of the second pin 240 are dimensioned smaller than the ends of the filter assembly 201. In the embodiment shown, the groove is parallel to the axis of rotation R-R. As the drum 210 rotates, the filter assembly 201 is brought into the operable view of the camera 220. At the same time the filter assembly 201 is within the operable view of the camera 220, the first pin 230 and the second pin 240 are brought into contact with the ends of the filter assembly. The pins are contacted with the assembly with a force suitable for compressing the filter assembly in its longitudinal direction if it contains a void, but not with such force that a voidless filter assembly will collapse, rupture or otherwise break. When the first and second pins are in contact with the filter assembly, the camera records the image for transmission to the evaluation device. In the embodiment shown in FIGS. 2 and 3, two values associated with the filter assembly are measured. The camera captures a value L which is the overall length of the filter assembly from the non-contact end of the first pin to the non-contact end of the second pin. The evaluation device is provided with an acceptable predetermined value for L which compensates for the inclusion of the length of the pins in the measured value L. The camera also captures values T1 and T2. T1 represents the distance from the non-contact end of the first pin 230 to the furthest protruding end of a segment at the adjacent end of the filter assembly 201. T2 represents the distance from the non-contact end of the second pin 240 to the furthest protruding end of a segment at the adjacent end of the filter assembly 201. The evaluation device can be provided with an acceptable variance between T1 and T2. If the measured values T1 and T2 differ by more than the predetermined value, the filter assembly is off-set having a protrusion of a segment at one end and a recess at the other end relative to the outer wrapping paper. As shown, the smaller dimensioning of contact end 232 and contact end 242 allow a recess at either end to be measured.

The first pin 230 and the first movable member 235 comprise a segment of a first rotating ring 250 disposed proximate to a first upper side of the rotatable drum 210. The first rotating ring 250 rotates in conjunction with the rotatable drum 110 and the first rotating ring 250 comprises a plurality of segments disposed along the circumference of the first rotating ring, each of the plurality of segments comprising a first pin 230 connected to a first member 235 capable of reciprocally moving the first pin to which it is connected into and out of contact with a first upper end of a filter assembly 201 disposed in one of the spaced grooves 211. The second pin 240 and second movable member 245 comprise a segment of a second rotating ring 260 disposed proximate to a second lower side of the rotatable drum 210, and the second rotating ring 260 rotates in conjunction with the rotatable drum 210. The second rotating ring 260 comprises a plurality of segments disposed along the circumference of the second rotating ring, each of the plurality of segments comprising a second pin 240 connected to a second member 245 capable of reciprocally moving the second pin to which it is connected into and out of contact with a second lower end of the filter assembly 201 disposed in one of the spaced grooves 211.

As shown in FIG. 3 the first rotating ring 250 and the second rotating ring 260 are centered on the axis of rotation R of the rotatable drum 210 and positioned for rotation at a non-right angle to the axis of rotation of the rotatable drum.

The present invention also includes methods for evaluating samples using inspection systems according to the various embodiments described above. One embodiment of a method according to the present invention includes providing a filter assembly in a receptacle disposed on a movable carrier, contacting a first end of the filter assembly with a first pin the pin having a contact end and a non-contact end, contacting a second end of the filter assembly with a second pin having a contact end and a non-contact end, measuring a value associated with the filter assembly while the pins are in contact with the filter assembly, and comparing the value to a predetermined value. A filter assembly can be provided in a receptacle on a movable carrier in a variety of ways, preferably via transfer from any suitable apparatus used for constructing filter assemblies. Thus, inspection systems of the present invention can be used in conjunction with other apparatuses and methods for providing filter assemblies. Filter assemblies can also be provided to receptacles on a movable carrier from any suitable storage facility for filter assemblies. The first pin and second pin can be brought into contact with the filter assembly in any manner such that the first and second pin contact the filter assembly at the same time, at which time a value associated with the filter assembly is measured, preferably by a measurement sensor in accordance with an inspection system of the present invention, and the measured value is compared to a determined value. Thus, in a preferred embodiment of the present invention, a camera measures an overall length of a filter assembly while the first pin and second pin are in contact with the filter assembly and a processor in connection with the camera compares the measured overall length to a predetermined suitable length for filter assemblies and determines whether or not that comparison exceeds a threshold value.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. An inspection system comprising:

a movable carrier having a plurality of spaced receptacles, each spaced receptacle sized to accept a sample;

a first pin positioned proximate to the movable carrier and connected to a first movable member capable of reciprocally moving the first pin alternately into and out of contact with a first end of a sample disposed in one of the spaced receptacles;

a second pin positioned proximate to the movable carrier and connected to a second movable member capable of reciprocally moving the second pin alternately into and out of contact with a second end of the sample disposed in the one of the spaced receptacles;

a measurement sensor capable of determining a value associated with the sample disposed in the one of the spaced receptacles; and an evaluation device in communication with the measurement sensor for receiving the value, the evaluation device providing a comparison between the value and a predetermined value.

2. The inspection system according to claim 1, wherein the sample comprises a filter assembly.

3. The inspection system according to claim 2, wherein the measurement sensor comprises a camera.

4. The inspection system according to claim 2, wherein an end of the first pin for contact with the first end of the filter assembly is dimensioned smaller than the first end of the filter assembly, and wherein an end of the second pin for contact with the second end of the filter assembly is dimensioned smaller than the second end of the filter assembly.

5. The inspection system according to claim 2, wherein the filter assembly has an overall length and the value determined by the measurement sensor is directly related to the overall length of the filter assembly.

6. The inspection system according to claim 2, wherein the movable carrier is in communication with the evaluation device for receiving a rejection signal when the comparison between the value and a predetermined value exceeds a threshold value.

7. The inspection system according to claim 6, wherein the movable carrier further comprises an ejector capable of receiving the rejection signal from the evaluation device and removing the filter assembly from the spaced receptacle.

8. The inspection system according to claim 2, wherein the movable carrier comprises a rotatable drum.

9. The inspection system according to claim 8, wherein the plurality of spaced receptacles comprises a series of equally spaced apart parallel grooves disposed on a surface of the rotatable drum, each of said grooves extending in a direction along the surface of the rotatable drum parallel to an axis of rotation of the rotatable drum.

10. The inspection system according to claim 9, wherein the axis of rotation of the rotatable drum is vertical and each of the parallel grooves is connected to a variable vacuum such that a filter assembly disposed in the groove can be held in place by the vacuum or removed upon reduction of the vacuum.

11. The inspection system according to claim 10, wherein the variable vacuum is in communication with the evaluation device for receiving a rejection signal such that the variable vacuum is temporarily reduced to remove the filter assembly from the groove.

12. The inspection system according to claim 9, wherein the first pin and the first movable member comprise a segment of a first rotating ring disposed proximate to a first side of the rotatable drum wherein the first rotating ring rotates in conjunction with the rotatable drum and wherein the first rotating ring comprises a plurality of segments disposed along the circumference of the first rotating ring, each of the plurality of segments comprising a first pin connected to a first member capable of reciprocally moving the first pin to which it is connected into and out of contact with a first end of a filter assembly disposed in one of the spaced grooves; and wherein the second pin and second movable member comprise a segment of a second rotating ring disposed proximate to a second side of the rotatable drum wherein the second rotating ring rotates in conjunction with the rotatable drum and wherein the second rotating ring comprises a plurality of segments disposed along the circumference of the second rotating ring, each of the plurality of segments comprising a second pin connected to a second member capable of reciprocally moving the second pin to which it is connected into and out of contact with a second end of a filter assembly disposed in one of the spaced grooves.

13. The inspection system according to claim 12, wherein the first rotating ring and the second rotating ring are centered on the axis of rotation of the rotatable drum and positioned for rotation at a non-right angle to the axis of rotation of the rotatable drum.

14. The inspection system according to claim 13, wherein the axis of rotation of the rotatable drum is vertical and each of the parallel grooves is connected to a variable vacuum such that a filter assembly disposed in the groove can be held in place by the vacuum or removed upon reduction of the vacuum.

15. The inspection system according to claim 14, wherein the measurement sensor comprises a camera.

16. The inspection system according to claim 14, wherein an end of the first pin for contact with the first end of the filter assembly is dimensioned smaller than the first end of the filter assembly, and wherein an end of the second pin for contact with the second end of the filter assembly is dimensioned smaller than the second end of the filter assembly.

17. The inspection system according to claim 16, wherein the measurement sensor comprises a camera.

18. The inspection system according to claim 16, wherein the variable vacuum is in communication with the evaluation device for receiving a rejection signal such that the variable vacuum is temporarily reduced to remove the filter assembly from the groove.

19. A method comprising:

(a) providing a sample in a receptacle disposed on a movable carrier;

(b) contacting a first end of the sample with a first pin, the first pin having a contact end and a non-contact end;

(c) contacting a second end of the sample with a second pin, the second pin having a contact end and a non-contact end;

(d) measuring a value associated with the sample while the first pin contact end and the second pin contact end are in contact with the sample; and (e) comparing the value to a predetermined value.

20. The method according to claim 19, wherein the sample comprises a filter assembly.

21. The method according to claim 20, wherein the value determined by the measurement sensor comprises a length from the non-contact end of the first pin to the non-contact end of the second pin.

22. The method according to claim 20, wherein the value determined by the measurement sensor comprises a length from the first end of the filter assembly to the non-contact end of the first pin.

23. The method according to claim 20, wherein the value determined by the measurement sensor comprises a length from the second end of the filter assembly to the non-contact end of the second pin.

24. The method according to claim 20, wherein the value comprises a light transmittance measurement between the first end and the second end of the filter assembly.

25. The method according to claim 20, wherein the value comprises two or more measurements selected from the group consisting of a length from the non-contact end of the first pin to the non-contact end of the second pin, a length from the first end of the filter assembly to the non-contact end of the first pin, a length from the second end of the filter assembly to the non-contact end of the second pin, and a light transmittance measurement between the first end and the second end of the filter assembly.

* * * * *

UNITED STATES PATENT AND TRADEMARK OFFICE

CERTIFICATE OF CORRECTION

PATENT NO. : 7,784,356 B2
APPLICATION NO. : 12/019217
DATED : August 31, 2010
INVENTOR(S) : Steven F. Spiers et al.

It is certified that error appears in the above-identified patent and that said Letters Patent is hereby corrected as shown below:

Cover Page, Item (75), line 4, should read:

Janet L. Smith Thompson.

Signed and Sealed this

Sixteenth Day of November, 2010

David J. Kappos

David J. Kappos
*Director of the United States Patent and Trademark Office*